United States Patent [19]

Theis, Jr.

[11] 3,930,744

[45] Jan. 6, 1976

[54] PRESSURE GAS ENGINE

[75] Inventor: James V. Theis, Jr., Delray Beach, Fla.

[73] Assignee: Hollymatic Corporation, Park Forest, Ill.

[22] Filed: Oct. 10, 1973

[21] Appl. No.: 405,092

[52] U.S. Cl. ..... 415/53 R; 415/63; 415/80; 415/122; 415/202

[51] Int. Cl.[2] ..... F04D 5/00

[58] Field of Search ..... 415/80, 92, 60, 63, 64, 415/69, 202, 53, 122

[56] References Cited

UNITED STATES PATENTS

| | | | |
|---|---|---|---|
| 111,538 | 2/1871 | Herron | 415/63 |
| 685,967 | 11/1901 | Boquist | 415/63 |
| 812,795 | 2/1906 | Keller | 415/202 |
| 858,500 | 7/1907 | Dake | 415/202 |
| 925,127 | 6/1909 | McDonald | 415/63 |
| 980,504 | 1/1911 | Edgar | 415/63 |
| 982,035 | 1/1911 | Clapp | 415/80 |
| 988,990 | 4/1911 | Fisher, Jr. | 415/81 |
| 1,079,177 | 11/1913 | Jones et al. | 415/63 |
| 1,110,302 | 9/1914 | Flatau | 415/80 |
| 1,454,286 | 5/1923 | Johnson | 415/80 |

FOREIGN PATENTS OR APPLICATIONS

| | | | |
|---|---|---|---|
| 350,070 | 7/1904 | France | 415/92 |
| 152,673 | 10/1920 | United Kingdom | 415/53 |
| 68,264 | 2/1951 | Netherlands | 415/53 |

*Primary Examiner*—C. J. Husar
*Assistant Examiner*—Edward Look
*Attorney, Agent, or Firm*—Hofgren, Wegner, Allen, Stellman & McCord

[57] ABSTRACT

A pressure gas engine having an inner first member of circular cross section with a periphery containing first energy conversion means for converting gas pressure to power and an outer second member extending around the first member and with a generally circular inner surface facing the outer surface of the first member and having second energy conversion means in the inner surface facing the first member and for converting gas velocity to power. In certain embodiments the inner and outer arrangements of the first and second members will be reversed. At least one of these first and second members is rotatable about an axis of rotation by the force exerted thereon due to the gas acting on its energy conversion means with one of the energy conversion means in either the first member or the second member comprising at least one and preferably a plurality of spaced converging-diverging nozzles each lying on a chord of its member that is less than the diameter and exhausting toward the other energy conversion means with the other energy conversion means comprising a series of impulse turbine buckets facing the nozzles. Each bucket is inclined with respect to its member and is adapted to be aligned with the nozzle exhaust on relative movement of the first and second members with respect to each other.

11 Claims, 7 Drawing Figures

PRESSURE GAS ENGINE

BACKGROUND OF THE INVENTION

One of the features of this invention is to provide a pressure fluid engine having an inner first member as one stage and an outer second member as a second stage extending around the first member and with one of the stages having at least one converging-diverging nozzle exhausting into at least one and preferably a series of turbine buckets located in the other member with the nozzle and bucket being on a chord of its respective member or stage that is other than a diameter, that is, being inclined with respect to the circumference of the respective members.

DESCRIPTION OF THE PREFERRED EMBODIMENTS

Figure 1:
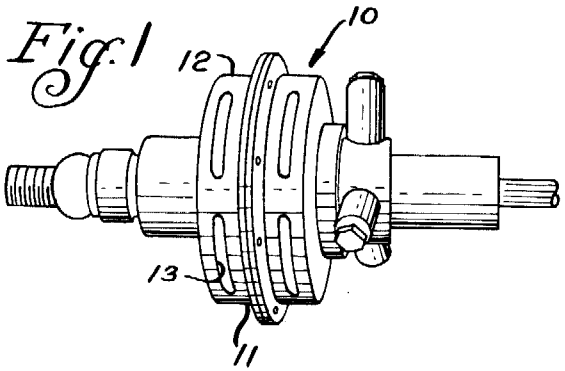
FIG. 1 is a perspective view of a pressure gas engine embodying the invention.

In the first embodiment of FIGS. 1–5 the pressure gas engine or turbine 10 is a multi-stage turbine using pressurized gas which may be either a cold gas such as compressed air or with proper insulation and other specialized features applicable thereto can be a hot gas turbine such as those using combustible fuel mixtures and the gaseous combustion products thereof. In this embodiment the engine 10 comprises a casing 11 having an enlarged portion 12 containing two sets of peripherally spaced vent holes 13 and in which is located the two stages of this engine.

Figure 4:
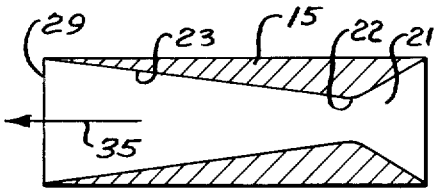
FIG. 4 is an enlarged sectional view illustrating a converging-diverging nozzle of this invention.

A first stage 14 may be of the type disclosed in the copending application Ser. No. 353,456, assigned to the same assignee as the present application. This inner first stage 14 is of circular cross section having first energy conversion means 15 at its periphery 16 for converting gas pressure to power. In the disclosed embodiment this energy conversion means 15 is in the form of a plurality of straight through nozzles here shown as converging-diverging nozzles illustrated semi-schematically in enlarged sectional detail in FIG. 4. The interior 17 of this first stage 14 which in the illustrated embodiment is an inner rotor is supplied with gas under pressure such as compressed air through a hollow axle 18 on which this rotor 14 is mounted for rotation therewith and which communicates with the rotor 14 through four equally spaced radial openings 19. By this means pressure gas flowing from the left in FIG. 2 into the hollow interior 20 changes direction from axial to radial to flow under pressure through the spaced openings 19 into the hollow interior 17 and outwardly to the converging ends 21 of the nozzles 15 (FIG. 4). The pressurized gas then flows through the throat 22 of each nozzle and exits through the diverging end 23 of each nozzle 15.

The end 24 of the axle beyond the rotor 14 extends through a gear box 25 and is attached to a power take-off shaft 26. As is customary the various rotatable parts including the shafts are mounted in the casing 11 on suitable ball bearings as illustrated.

The pressure gas engine is also provided with a second stage or outer second member rotor 27 surrounding the first member or inner rotor 14 and provided with second energy conversion means in the form in this embodiment of turbine buckets which convert gas velocity to power. Means are provided for mounting at least one of the first 14 and second 27 members or stages for rotation relative to the other by force exerted thereon. In the illustrated embodiment both stages are mounted as rotors for rotation.

Figure 3:
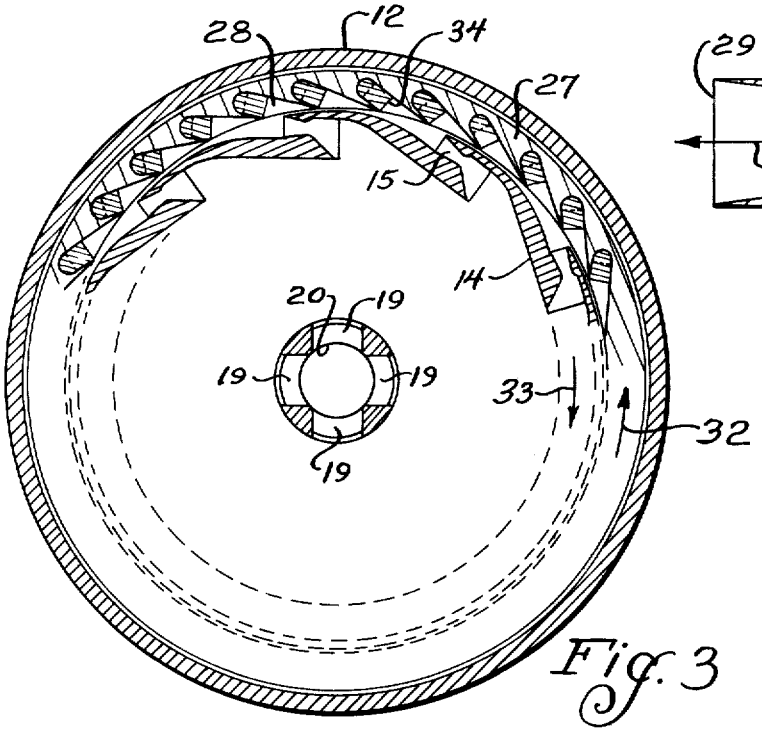
FIG. 3 is a transverse fragmentary sectional view taken substantially along line 3—3 of FIG. 2.

As can be seen in FIG. 3 each nozzle 15 and each bucket 28 lies along a chord of its member 14 and 27 that is less than a diameter or, in other words, is inclined with respect to the circumference of the respective member.

Figure 2:
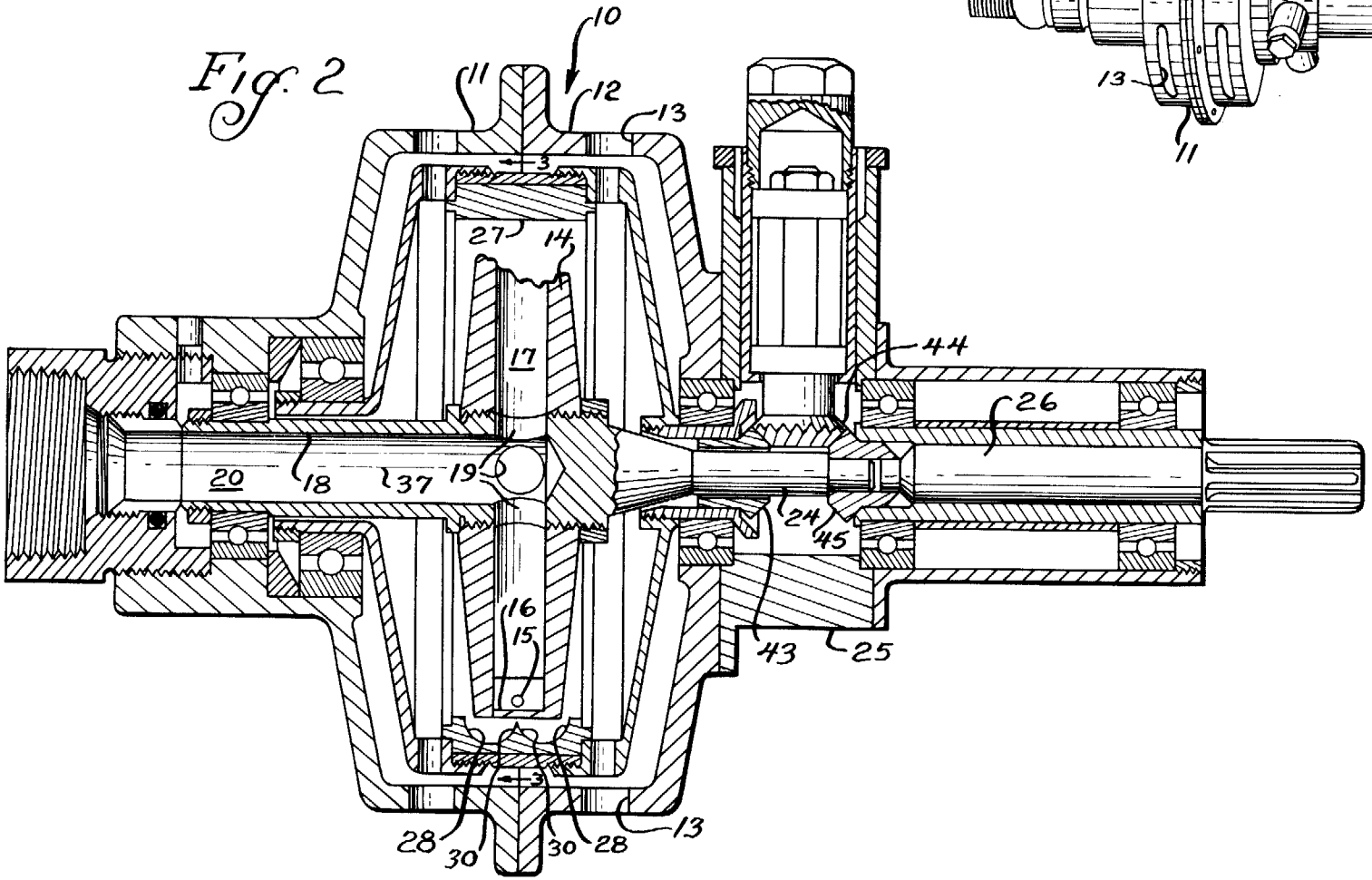
FIG. 2 is an enlarged longitudinal sectional view taken through the center of the engine except angled to pass through the centers of a pair of adjacent buckets at the bottom of the engine and with portions of the engine broken away for clarity of illustration.

In order to illustrate in FIG. 2 the embodiment in which the buckets 28 are in two side-by-side circumferentially extending sets the section line of FIG. 2 is angled at the bottom of the outer rotor 27 to pass symmetrically through a horizontally aligned pair of buckets 28 in the two sets.

As is illustrated in FIG. 3 rotation of either or both inner members 14 and outer member 27 relative to each other within the casing enlargement 12 causes each nozzle 15 to be aligned with the series of buckets 28 successively. This causes an efficient conversion of force from the velocity in the pressurized gas flowing from each nozzle exit 29 to act upon the buckets 28 and convert this force into rotational power.

As is illustrated in FIG. 2 the exhaust from each nozzle 15 first strikes adjacent one edge 30 of a bucket 28 and then flows along the surface of the respective bucket to exhaust from the opposite edge 31 and finally through the casing vent holes or slots 13. This passage of the gas in a wiping action across the convex surface of the buckets 28 results in the conversion of the remaining energy of the gas in this embodiment into rotary power. In order to aid the efficiency of the conversion of this energy into power each bucket 28 is of substantially constant radius and extends transversely to the direction of rotation 32 of its outer rotor 27 which is opposite to the direction of rotation 33 of the inner rotor 14. Thus as can be seen the inner rotor 14 in the illustrated embodiment functions as a reaction rotor while the outer rotor 27 functions as an impulse rotor both powered by the same flow of gas therethrough and with the converging-diverging nozzles 15 being necessary for an efficient conversion of gas pressure into velocity in the reaction rotor.

As is illustrated, this embodiment has a plurality of buckets 28 arranged in two circular sets with corresponding buckets being side-by-side adjacent each other. The adjacent buckets in adjacent sets as illustrated at the bottom of FIG. 2 as well as in the embodiments of FIGS. 5, 6 and 7 have a common edge 34 positioned opposite the exit or exhaust end 29. With this arrangement the exhaust 35 (FIG. 4) is divided substantially equally into the two circular sets of buckets 28. In addition, in the preferred embodiment the outer sides 36 forming each side-by-side pair of buckets is extended inwardly toward the axis of rotation 37 to the outer extremities of the inner rotor 14 but spaced therefrom. This construction tends to aid in preventing pumping of the gas by the rotating rotors 14 and 27 which would have a severe effect in reducing the efficiency of the conversion of gas energy to power.

The transverse arcuate surface forming each bucket 28 extends for about 90°–270° and conveniently about 180° in the illustrated embodiments. Furthermore, the converging-diverging nozzles may be of the customary type, one type having the sides of the converging end 21 arranged at about 60° included angle and the sides forming the diverging end 23 being at about 15° included angle.

Although in the illustrated embodiment both of the first and second members 14 and 27 rotate relative to each other it is within the province of this invention to have the nozzles positioned in either the inner or outer member with the buckets being in the other member and also to have the nozzle containing member fixed to function as a nozzle plate leaving the impulse bucket member to serve as the only rotor. Furthermore, although in the illustrated embodiment there are two sets of buckets 28 it is believed obvious that more could be employed or even a single set of buckets if desired as the exhaust 29 of the nozzles are adjacent an edge 30 of the bucket 28 for flow therearound to the opposite exhaust edge.

As illustrated in FIG. 3 this engine has each nozzle 15 exhausting into each set of buckets 28 successively. If desired each nozzle could exhaust simultaneously into a plurality of buckets by enlarging the dimensions of the nozzle. Thus in one embodiment with each diverging end 23 of a nozzle exhausting into three buckets simultaneously the throat 22 was made substantially three times as large as the throat area for a nozzle exhausting into a single set of buckets.

Figure 5:
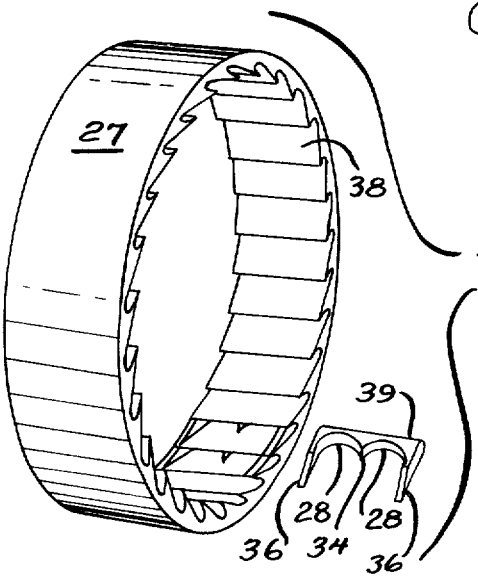
FIG. 5 is a perspective view illustrating the outer rotor in the embodiment of FIG. 2 showing a replaceable pair of buckets.

As shown in FIG. 5 the outer rotor 27 may be in the form of a ring with the inner surface provided with overlapping slots 38 in which may be releasably secured slugs 39 so dimensioned as to fit snugly within the slots 38 and with each slug 39 containing the pair of buckets 28, the edge or peak 34 and the overlapping sides 36, all as previously described.

Figure 6:
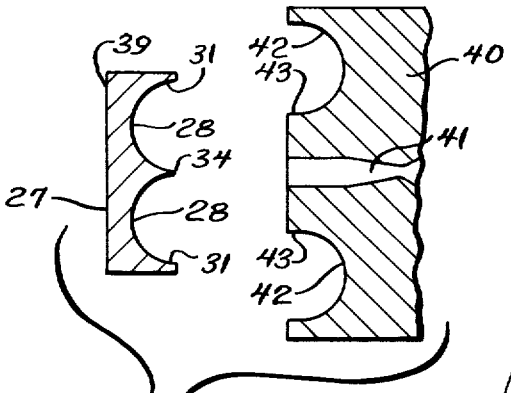
FIG. 6 is a schematic fragmentary sectional view through a nozzle and associated turbine buckets of a second embodiment of the invention.
Figure 7:
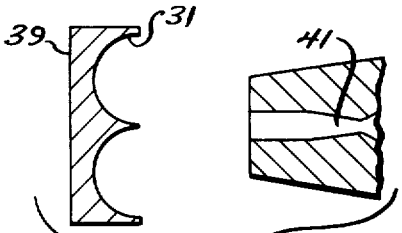
FIG. 7 is a view similar to FIG. 6 but illustrating the bucket-nozzle combination of the first embodiment.

In the embodiment of FIG. 6 the inner rotor 40 which contains the plurality of nozzles 41 may itself contain two circular series of buckets 42 that are essentially the same as the buckets 28 and that receive at an inner edge section 43 the gas exhaust from the outer edge 31 of the buckets 28. The showing in FIG. 6 is of course semi-schematic.

Although the buckets 28 are most conveniently located in the outer rotor 27 and face inwardly with the nozzles of the inner rotor 14 exhausting outwardly, the reverse of these conditions may be used if desired.

With the double rows of buckets 18 and the nozzles 15 exhausting at the common edge 34 of each pair of laterally adjacent buckets the gas from the nozzles is divided equally to flow through the two sets of buckets. In one example each nozzle (FIG. 4) was a 60° included converging-15° included diverging nozzle with a 0.140 inch throat and with a 0.5 inch diameter entrance and 0.188 inch diameter exit. The exit 29 was centered at the adjacent edge of the pairs of buckets and each bucket was arcuate through 180° with a ⅝ inch diameter.

As the gas enters each nozzle and flows through the converging portions 21 it loses pressure as the cross sectional area of the end of the nozzle is reduced with corresponding increase in velocity until the velocity is at a maximum at the nozzle throat 22. The largest velocity that can be achieved in the throat is sonic velocity. Then as the gas flows from the throat through the diverging section 23 to the nozzle exhaust end or exit 29 the gas escapes the nozzle at a velocity greater than sonic velocity.

It is not necessary to have two sets or circular rows of side-by-side buckets 28 in either the outer or inner rotor as power can be generated with even a single row of buckets so long as the nozzle exhaust gas enters each bucket adjacent one edge 30, is directed around the arcuate surface 28 and leaves the buckets at the opposite edge 31 and the buckets 18 are inclined with respect to a radius or, in other words, are aligned with a chord that is not a diameter. In this device there can be a single nozzle exhausting into a plurality of circularly arranged buckets or a single bucket supplied serially by a number of nozzles arranged in a circle.

Because the entrance to each bucket in the circumferential series is on a radius of the bucket and adjacent a bucket edge, there is very little loss of power due to a pumping action exerted on the gas. In a practical design the buckets are arranged in two side-by-side sets with laterally adjacent buckets being joined at a sharp edge crest and the nozzles arranged so that they exhaust into the buckets at the crests. This distributes the gas evenly into the pairs of buckets. By gearing the inner 14 and outer 27 rotors together as with the gear 43 and gear trains 44 and 45 shown in the illustrated embodiments, both rotors 14 and 27 may drive the single common power shaft 26. If desired, of course, each inner 14 and outer 27 rotor may be connected to drive a separate shaft.

By counter-rotating the inner reaction rotor 14 and the outer impulse rotor 27 (or vice versa) the speed of each is reduced, centrifugal loading is reduced and substantially twice the torque is achieved on a common driven shaft 24 at about one-half the shaft rpm that would be achieved with a single stage.

The horsepower achieved by a counter-rotating reaction-impulse pressure gas engine quickly reaches a peak at an rpm that is about midway between zero and the maximum rpm. Thus in one example the horsepower achieved was about 18 at 20,000 rpm and a nozzle center speed of about 500 feet per second. As the shaft rpm is further increased the horsepower dropped toward zero.

By omitting the nozzle reaction stage and exerting straight impulse power developed by the buckets only, the maximum horsepower was again 18 but at an rpm of approximately 40,000 and a nozzle center speed of about 1,000 feet per second. Thus with the reaction-impulse counter-rotating engine the maximum horsepower was achieved at a lower rpm and at a lower nozzle center speed. In both instances the horsepower was approximately double that achieved by a single stage reaction rotor.

In order to achieve peak efficiency of operation the buckets 28 in the impulse stage should all be substantially filled with high velocity gas under pressure at any given time while the engine is running. The bottoms of the buckets in the impact stage or stages are rounded in order to maintain smoooth flow into and out of each bucket especially when the relatively moving outer buckets split the gas stream from each nozzle. This results in smooth continuous power being developed at low noise levels.

Although the illustrated embodiments show counter-rotating inner and outer rotors with the outer rotor being a combined stator and rotor the counter-rotating is not essential to the invention. Thus if desired either rotor may be held stationary while permitting the other to rotate. In this instance with all other factors being equal the single rotor would operate at approximately twice the combined speed of the counter-rotating rotors.

The engine where the reaction rotor and impulse rotor counter-rotate has a number of advantages. Thus it reduces the bucket speed to approximately one-half as it involves the relative speed of rotation between the two counter-rotating parts. It also serves to reduce the number of stages required for peak efficiency at a given rpm and permits achieving approximately the entire designed or theoretical power. This means that the invention is applicable to all types of pressurized gas engines from small air motors to extremely large hot gas motors of as large as 100,000 horsepower for example. This is true because the combined reaction-impulse stages of the nozzles and the buckets as explained herein is a fundamentally sound design for achieving maximum efficiency of power development.

In the illustrated embodiments the two series of circularly arranged buckets have each pair of side-by-side buckets separated by a sharp edge 34. If desired, however, this edge could be rounded without significant loss of power.

Observations have shown that having counter-rotating inner and outer rotors as described herein produces higher efficiency and high performance as it reduces the number of direction of flow changes in the fluid flowing through the engine for a given working rpm velocity. Furthermore, the inner rotor that contains the converging-diverging nozzles provides a very efficient source of rotary power in and of itself as illustrated in the above application Ser. No. 353,456 and also efficiently supplies high velocity gas under dynamic flow conditions to the impulse stage which is here illustrated as the outer rotor. Thus in one embodiment at a nozzle speed of 485 feet per second and using convergent-divergent nozzles a flow rate of air of 15 cubic feet per minute of gas flow per horsepower developed was achieved from a source of air at about 80°F. and 85 psig.

Although certain statements of theory are contained herein the invention is not to be limited to any particular theory of construction or operation.

I claim:

1. A pressure gas engine, comprising: an enclosing casing with spaced outlet openings; an inner first member in said casing of substantially circular cross section having first energy conversion means at its periphery for converting dynamic gas velocity to power; an outer second member in said casing surrounding said first member and having second energy conversion means facing said inner first member also for converting dynamic gas velocity to power; power means including a work output power shaft for mounting one of said first and second members additional means for mounting the other of said first and second members to effect relative rotation therebetween when said power is exerted on one of said first and second members, one of said energy conversion means comprising a straight through gas nozzle having a converging entrance, a throat and a diverging exhaust, said nozzle lying on a chord of its said member that is less than a diameter and exhausting into the other energy conversion means, said other energy conversion means comprising a series of impulse turbine buckets each spaced in its entirety from said member containing said nozzles and facing said nozzles, each bucket having an arcuate surface of constant radius transverse to the direction of said rotation, each said nozzle having its exhaust entering each bucket adjacent one edge for generally arcuate travel around said arcuate surface of the bucket and leaving the bucket at an exhaust edge that is opposite said one edge in an energy transmitting wiping action; means for supplying pressure gas to the converging end of said nozzle; and means for exhausting gas from said exhaust edges of said buckets in substantially unrestricted gas flow substantially directly into said casing for escape through said outlet openings in the casing.

2. The engine of claim 1 wherein said inner first member and said outer second member are both rotatable about a common axis with one of said members containing a plurality of said nozzles and the other of said members containing said impulse turbine buckets for receiving gas exhaust from the nozzles, and there is provided a single said work output power shaft and said additional means comprises gearing means connecting both said rotatable first and second members to said single shaft for driving the same.

3. The engine of claim 1 wherein said impulse turbine buckets are arranged in a plurality of circular side-by-side series with adjacent buckets in adjacent series having a common sharp edge positioned opposite the nozzle exhaust whereby the exhaust is divided by said edge for simultaneous flow into the adjacent buckets.

4. The engine of claim 1 wherein said buckets are arranged in two side-by-side circular series with the adjacent edges of adjacent buckets being joined at a sharp edge and the opposite exhaust edges of the buckets being extended to overlap the side of the member containing the nozzle as an aid in preventing pumping of the gas by the rotating member.

5. The engine of claim 1 wherein said arcuate surface of each said bucket extends for about 90°–270°.

6. The engine of claim 1 wherein said arcuate surface of each said bucket extends for about 180°.

7. The engine of claim 1 wherein said inner first member is rotatable and has a hollow interior bounded by a peripheral wall in which are located a circular series of said nozzles each communicating with said hollow interior.

8. The engine of claim 7 wherein each said nozzle discharges generally tangentially and in the same direction relative to the circumference of said wall.

9. The engine of claim 1 wherein said inner first member and said outer second member are both rotatable about a common axis with one of said members containing said nozzle and the other of said members containing said impulse turbine buckets for receiving gas exhaust from the nozzle.

10. The engine of claim 9 wherein there are a plurality of said nozzles arranged in circular series around the periphery of said first member rotor and exhausting toward said second member rotor and said buckets are arranged in a pair of circular series with an adjacent pair of buckets in the series being aligned substantially parallel to the axis of rotation and having closely adjacent sides.

11. The engine of claim 1 wherein said buckets are arranged in a pair of closely adjacent circular series with each pair of laterally adjacent buckets in the two series being joined at a common sharp edge for receiving the exhaust of said nozzle and the opposite edge of each bucket exhausting into a circular series of buckets arranged in the same member containing the nozzle and with the nozzle member buckets being in two sets circularly arranged on opposite sides of said nozzle.

* * * * *